United States Patent [19]

Burke

[11] 3,933,206

[45] Jan. 20, 1976

[54] HEAT-RESPONSIVE AEROSOL VALVE

[75] Inventor: James E. Burke, N. Riverside, Ill.

[73] Assignee: VCA Corporation, Greenwich, Conn.

[22] Filed: Aug. 29, 1974

[21] Appl. No.: 501,602

[52] U.S. Cl. ..... 169/26; 222/402.14; 222/402.24; 222/54

[51] Int. Cl.[2] ..... A62C 35/02

[58] Field of Search ..... 169/26; 222/394, 396, 397, 222/402.1, 402.14, 402.24, 54

[56] References Cited

UNITED STATES PATENTS

| | | | |
|---|---|---|---|
| 3,114,483 | 12/1963 | Kappel | 222/402.24 |
| 3,613,793 | 10/1971 | Huthsing | 169/26 |

*Primary Examiner*—Allen N. Knowles
*Attorney, Agent, or Firm*—H. Gibner Lehmann; K. Gibner Lehmann; E. Donald Mays

[57] ABSTRACT

A heat-responsive valve construction for use with pressurized containers such as aerosol cans and the like, comprising an annular mounting cup in which there is contained an apertured sealing gasket and also a rigid washer engaged with the gasket. Passing through the cup, gasket and washer is an axially shiftable valve stem having an axial bore in its outer end and having lateral or side orifices intermediate its ends, which communicate with the bore. The outer end of the valve stem also has a plurality of heat-sensing arms extending radially and then axially from the end of the stem in spaced relation thereto, said arms being engaged with the top of the mounting cup. A connector ring joins the ends of the arms where they engage the cup. The other end portion of the valve stem carries a compression spring which is engaged with the rigid washer in the cup and also with an abutment on the stem. The spring applies pressure to the washer, which in turn presses the sealing gasket against the underside of the top wall of the cup. Spring pressure is thus exerted through the stem on the heat-responsive arms, and maintains these in engagement with the top surface of the cup. Under conditions of excessive heat, the arms weaken and yield, being aided by the action of the coil spring, and the latter thereupon shifts the valve stem to move the side orifices thereof completely through the sealing gasket whereby they communicate with the interior of the container to enable discharge of the pressurized liquid therein through the bore of the stem.

10 Claims, 12 Drawing Figures

HEAT-RESPONSIVE AEROSOL VALVE

BACKGROUND

This invention relates to pressurized containers intended to carry fire extinguishing liquid and to be automatically operated to discharge said liquid under conditions of excessive heat. In the past, fire extinguisher installations in the form of piped automatic sprinkler systems have been provided with heat-responsive valves so arranged that a whirling orifice comes into play to discharge extinguishing liquid in the event of a fire. Such systems and valves, while operating satisfactorily, have been costly to manufacture, and the installation (in conjunction with the required liquid distribution pipes) has represented an appreciable expense. Often it could be of advantage to provide an automatic fire extinguisher merely at localized areas, some inaccessible or shielded from the extensive overhead installation. Heretofore, equipment intended for such specialized applications or areas was complicated and costly, and required special piping to bring in the extinguishing liquid to the particular area intended for protection.

SUMMARY

The above disadvantages and drawbacks of prior fire extinguishing systems are obviated by the present invention, which has for its main object the provision of a novel and improved, especially simple and inexpensive heat-responsive valve adaptable for use with pressurized containers, the installation of which can be easily and quickly effected without requiring extensive piping, water lines and the like. A related object of the invention is to provide an improved heat-responsive aerosol valve as above set forth, which is readily adaptable to existing metal containers such as are commonly used with various types of aerosol products. A feature of the invention resides in the provision of an improved heat-responsive fire extinguisher valve in accordance with the foregoing, which consists of relatively few parts that may be economically molded of plastic substances, and easily and quickly assembled to provide a reliable valving means for a pressurized container.

The above objects are accomplished by a heat-responsive aerosol valve construction for pressurized containers and the like, comprising an annular mounting member having a through passage, a resilient sealing gasket having an opening in alignment with the passage, a spring biased valve stem extending through the opening and passage and having a bore with side passages communicating therewith, and heat-responsive means connected with one end of the stem and engaged with the mounting member for maintaining the stem in a sealing, non-discharging position against the action of the spring wherein the side orifices of the stem are normally sealed off from the interior of the container by the gasket. One end of the spring engages a rigid washer which presses the sealing gasket into engagement with the underside of the mounting member. The other end of the spring engages a shoulder on the inner end of the valve stem. The arrangement is such that upon exposure to heat, the heat-responsive means yields, and the spring biases the valve stem to an open, discharging position wherein the side orifices thereof bypass the sealing gasket and communicate with the interior of the container via notches in the inner periphery of the rigid washer. As a result, fluid from the container can flow out through the orifices and the bore of the stem to be directed toward the source of the heat or fire.

Still other features and advantages will hereinafter appear.

Figure 1:
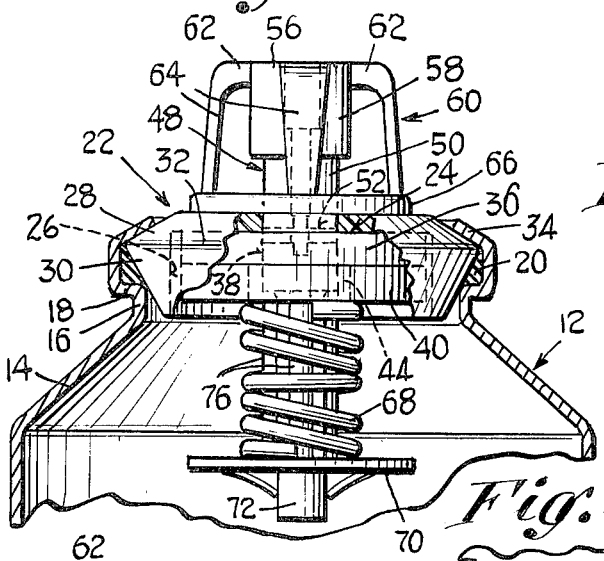
FIG. 1 is a view partly in axial section and partly in side elevation of a pressurized aerosol container having incorporated therein the heat-responsive valve of the invention.
Figure 9:
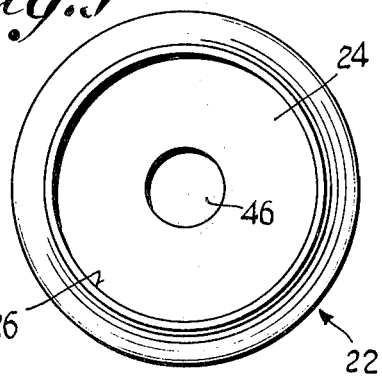
FIG. 9 is a bottom plan view of the mounting cup of the heatresponsive valve.

Referring first to FIG. 1 there is illustrated a pressurized container 12 which can be of conventional type, having a reduced shoulder portion 14 and a neck portion 16, the latter providing an annular seat 18 in which there is carried a sealing ring 20. In the neck portion 16 of the container 12 is a mounting member or cup 22 comprising an annular, flat top wall portion 24 and a circular side wall portion 26 (FIG. 9). The outer periphery of the cup 22 is preferably formed with bevelled surfaces, as provided by a conical upper surface 28 meeting with a conical lower surface 30 and a circular juncture or parting line 32. The mounting cup 22 is sealed to the container neck 16 by the ring 20, and is permanently held in place by crimping inward the top edge portion 34 of the container neck 16 in the well-known manner.

Figure 6:
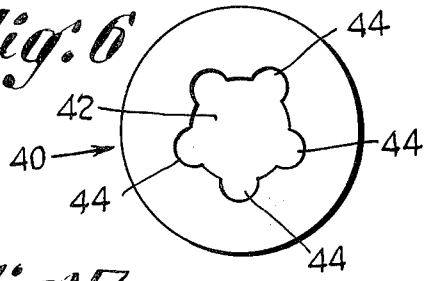
FIG. 6 is a top plan view of a rigid washer as employed with the heat-responsive valve.
Figure 7:
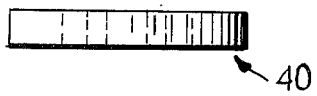
FIG. 7 is an edge view of the washer of FIG. 6.
Figure 8:
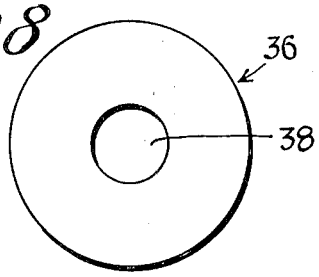
FIG. 8 is a top plan view of the sealing gasket employed in the valve construction.

According to the present invention there is provided, in conjunction with the mounting cup 22, a unique and improved heatresponsive valve assemblage comprising a sealing gasket 36 (FIG. 8) in the form of a flat washer having a central opening 38, said gasket being constituted of resilient plastic substance or rubber, or rubber-like material. The gasket 36 is located in the cup 22 with one face in contact with the undersurface of the top wall 24 of the cup, as shown. Below the gasket 36 there is provided a rigid washer 40 (FIGS. 6, 7) of commensurate diameter, said washer having a central opening 42 and also a plurality of notches 44 in its inner periphery for purposes to be explained later.

Figure 2:
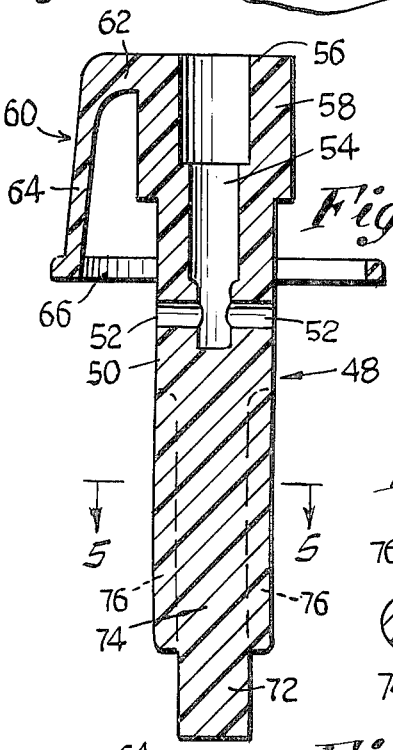
FIG. 2 is an enlarged axial sectional view of the valve stem portion of the heat-responsive valve, taken on line 2—2 of FIG. 3.
Figure 3:
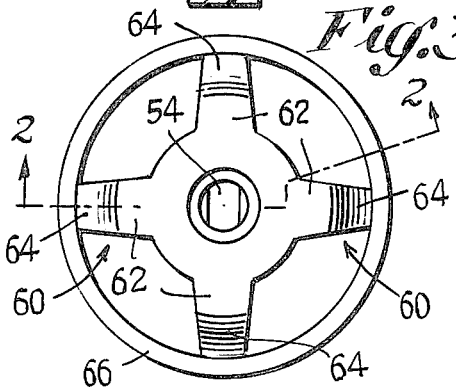
FIG. 3 is a top plan view of the valve stem.

Passing through the sealing gasket 36 and washer 40, whose central openings are aligned, and through a central opening 46 in the mounting cup 22 is a molded plastic valve stem 48 having a smooth shank portion 50 adapted to closely fit the opening 38 of the gasket and constitute a secure seal therewith. Referring to FIGS. 2 and 3, in the shank portion 50 are lateral orifices 52, communicating with a central axial bore 54 of the valve stem, which opens at the top end 56 thereof.

As illustrated in FIG. 1, the side orifices 52 are disposed generally above the sealing gasket 36 whereby the latter effects a seal with that part of the shank 50 which is located below the orifices.

Figure 4:
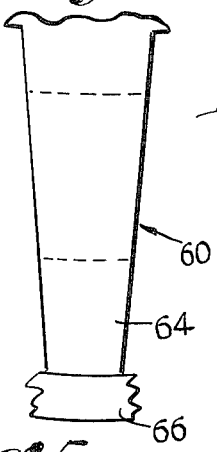
FIG. 4 is a fragmentary side elevational view of the stem, showing one of the heat-responsive arms thereof.

The upper portion of the valve stem 48 has a wall 58 of enlarged outer diameter from which there extend slender, heatresponsive arms 60, shown in FIGS. 2–4. The arms 60 have uppermost portions 62 which project radially outward, and have depending portions 64 extending downward in spaced relation with the valve stem and terminating in a circular connector ring 66 which rests against the top surface of the mounting member or cup 22. The arms 60 are intended to be substantially straight where they surround the upper portion of the valve stem 48, and are so constituted that they yield and deform in response to excessive heat.

At its inside portion the valve stem 48 carries a compression coil spring 68, at one end engaged with the rigid washer 40 and at the other end with a Tinnerman (trademark) speed nut 70, which is forced onto the lower extremity 72 of the stem. The coil spring 68 is under continual compression, and maintains the connector ring 66 firmly engaged with the top surface of the mounting cup 22, thus positioning the side orifices 52 of the valve stem generally above the sealing gasket 36. With such arrangement the pressurized liquid in the container 12 is prevented from being discharged due to the seal existing between the gasket 36 and the somewhat smooth shank portion 50 of the valve stem located immediately below the side orifices 52.

At the time that the heat-responsive arms 60 are subjected to excessive heat, the force of the spring 68 will cause them to yield and deform, whereupon the valve stem 48 will be forced downward by the spring as in FIG. 10, to thereby bring the orifices 52 below the sealing gasket 36 and into the area of the bore 42 of the rigid washer 40. The notches 44 in the washer bore are so located that one notch will always be in communication with a side orifice 52 for such condition. In consequence there is provided a discharge passage for the liquid in the container 12, and such liquid can now flow outward through the notches 44, orifices 52 and bore 54 of the valve stem.

It will be understood that the pressurized container 12 is intended to be operated in its inverted position whereby the valve construction is below the container body. Thus, the pressurizing gas in the container will force all of the liquid thereof out through the discharging valve stem.

Figure 5:
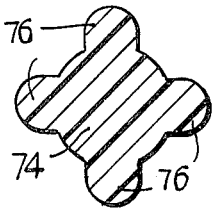
FIG. 5 is a transverse section taken on the line 5—5 of FIG. 2.

For the purpose of saving on material in the molding of the stem 48, the lower shank portion 74 thereof can be of reduced diameter and provided with several ribs 76 as illustrated in FIGS. 2 and 5.

Figure 10:
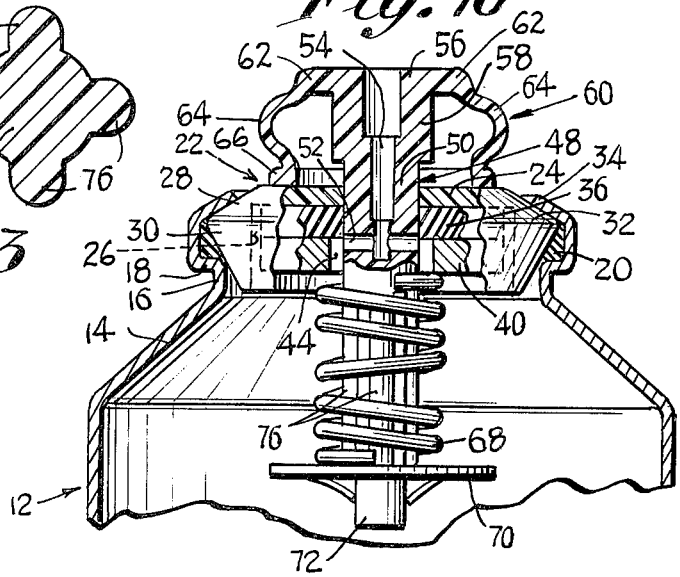
FIG. 10 is a view like that of FIG. 1, but showing the valve in the operative position.
Figure 11:
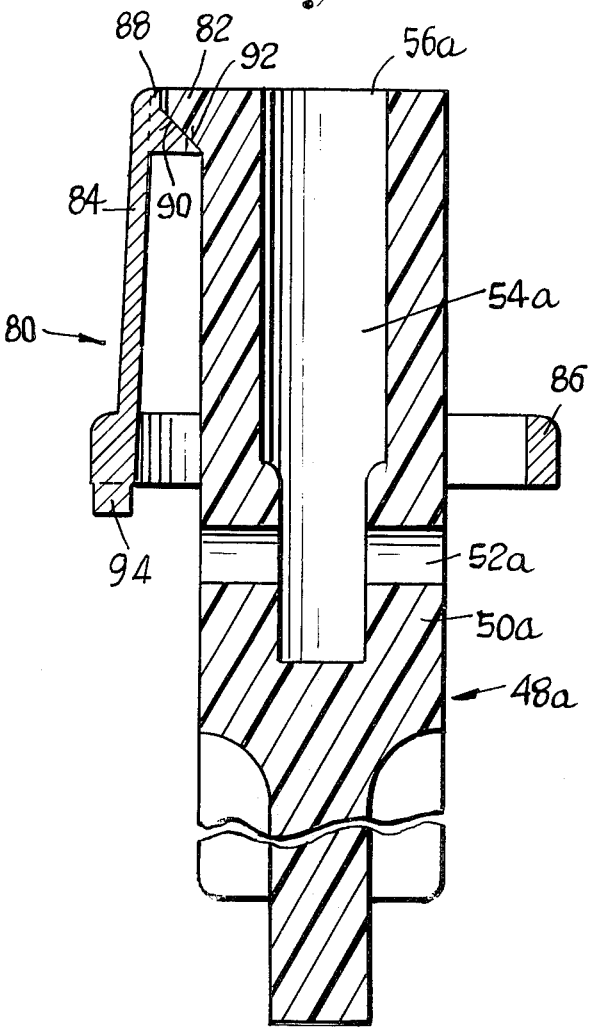
FIG. 11 is an enlarged axial sectional view of another embodiment of the invention, showing a modified valve stem, wherein heat-responsive arms which are joined by a connecting ring are constituted as a separate piece.
Figure 12:
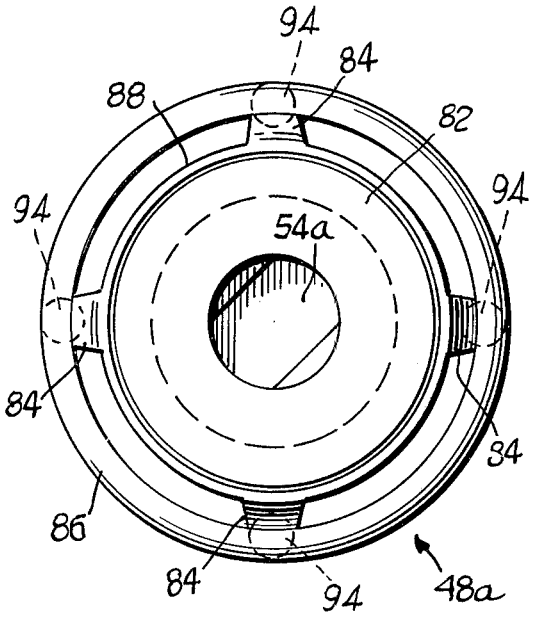
FIG. 12 is a top plan view of the construction of FIG. 11.

Another embodiment of the invention is illustrated in FIGS. 11 and 12, showing a modified valve stem 48a, adapted to be substituted for the valve stem 48 in the embodiment of FIGS. 1-10. Similar to the first embodiment, the stem **48*a* has a smooth shank portion 50*a* which is adapted to closely fit the opening 38 of the gasket, a central bore 54*a*, and lateral orifices 52*a* communicating with the bore. The latter is open at the top end 56*a*** of the stem, as shown.

By the present invention there is provided a heat-responsive ring assemblage, generally designated by the numeral 80, adapted to engage an enlarged end portion 82 of the valve stem **48*a*. The ring assemblage comprises a plurality of heat-sensitive arms 84 extending in a generally downward direction in spaced relation with the valve stem, and terminating in a circular connector ring 86 having four bosses 94 which are adapted to engage the top surface of the mounting cup 22. At the upper ends of the arms 84, an additional connector ring of circular configuration is provided, the ring being designated by the numeral 88. As best shown in FIG. 11, the ring 88 has an upwardly facing annular surface 90 which is of substantially conical configuration, this surface being adapted to engage a corresponding downwardly facing annular surface 92 on the underside of the uppermost portion or shoulder 82 of the valve stem 48*a***.

In this embodiment the valve stem is molded of plastic, and the connector ring assemblage 80 preferably constituted of a lowmelting point metal alloy. Such a construction has been found to provide improved heat response over that which is realizeable with an all-plastic consturction. As a result, better uniformity and more reliable overall performance is obtainable. It is noted that during assembly, the connector ring assemblage 80 is first placed on the upper surface of the mounting cup 22, after which the valve stem **48*a* is inserted through the hole therein. By the action of the bevelled surfaces 90, 92 the connector ring assemblage 80 is centralized with respect to the mounting cup 22 and container 12, and is held in place by the action of the spring 68 which biases the valve stem in a downward direction in FIG. 11**, as will be understood.

The operation of this embodiment is substantially similar to that of the first; as the arms 84 are subjected to heat, they undergo substantial yielding and deformation comparable to that illustrated in FIG. 10.

It will now be understood from the foregoing that I have provided a novel and improved heat-responsive valve construction for pressurized containers such as aerosol cans and the like, by which such containers will constitute effective and easy-to-use fire extinguishers that are automatically operative. The containers can be placed in small or cramped areas which are normally inaccessible from above, and require no expensive installation fittings or lines for connection with extended water pipes and the like.

Variations and modifications are possible without departing from the spirit of the invention.

I claim:

1. A heat-responsive valve construction for pressurized containers, comprising in combination:

a. a mounting member adapted for securement to the open end of a container for pressurized liquid, said member having a through passage;

b. a resilient sealing gasket secured against the mounting member, said gasket having an opening through it which is aligned with the passage of the member;

c. a rigid washer disposed adjacent the sealing gasket so as to back up the same and having an opening aligned with that of the gasket and mounting member;

d. a valve stem extending through said mounting member, sealing gasket and rigid washer and projecting from both sides of the mounting member, said valve stem having a bore in one end communicating with side orifices disposed intermediate its ends;

e. normally rigid heat-responsive means adjoining the said one end of the valve stem and engaged with the mounting member, said means positioning the side orifices of the stem at that side of the sealing gasket which faces the mounting member and yielding structurally in response to excessive heat; and f. spring means carried by the valve stem at the other end thereof and engaging the rigid washer for maintaining said heat-responsive means under continual stress and for biasing the valve stem in a direction to shift the side orifices thereof entirely through the sealing gasket.

2. The invention as set forth in claim 1, wherein:

a. the mounting member comprises an inverted cup having an apertured top wall, b. said sealing gasket engaging the underside of the top wall of the cup, c. said heat-responsive means engaging the upper side of the top wall of the mounting cup.

3. The invention as defined in claim 1, wherein:

a. the heat-responsive means comprises a plurality of slender arms attached to the outer end of the valve stem and extending alongside the latter to the mounting member.

4. The invention as set forth in claim 4, and further including:

a. a connector ring engaged with the mounting member and joined to the ends of said slender arms.

5. The invention as set forth in claim 1, wherein:

a. the spring means comprises a helical compression spring encircling the valve stem below said side orifices, and b. a push nut carried by the end of the valve stem and constituting an abutment shoulder engaged with one end of the coil spring.

6. A valve as in claim 1, wherein:

a. said rigid washer has notches in its inner periphery, providing clearance passages adapted to communicate with the side orifices of the valve stem after the latter have been shifted through the sealing gasket.

7. The invention as defined in claim 1, wherein:

a. said heat-responsive means comprises a plurality of slender heat-responsive arms connected with the outer end of the valve stem and extending alongside the latter to the mounting member, b. said slender arms being constituted as pieces separate from the stem.

8. The invention as defined in claim 7, wherein:

a. said arms are constituted of low melting point alloy.

9. The invention as defined in claim 7, wherein:

a. the outer end of said valve stem has a shoulder surface presenting an annular underside, b. a connector ring joining the ends of the heat-responsive arms which are adjacent the said outer end of the valve stem, c. said connector ring engaging the annular underside of the stem so as to be retained thereby.

10. The invention as defined in claim 9, wherein:

a. said underside of the stem and said connector ring comprise cooperable conical camming surfaces which act to centralize the ring with respect to the valve stem.

* * * * *

UNITED STATES PATENT OFFICE

CERTIFICATE OF CORRECTION

PATENT NO. : 3,933,206

DATED : January 20, 1976

INVENTOR(S) : James E. Burke

It is certified that error appears in the above-identified patent and that said Letters Patent are hereby corrected as shown below:

Column 4, line 22, reads "consturction", should read -- construction --. Column 5, line 26, reads "in Claim 4", should read -- in Claim 3 --.

Signed and Sealed this eighteenth Day of May 1976

[SEAL]

*Attest:*

RUTH C. MASON
*Attesting Officer*

C. MARSHALL DANN
*Commissioner of Patents and Trademarks*